US010112163B2

(12) United States Patent
Beardsley

(10) Patent No.: US 10,112,163 B2
(45) Date of Patent: Oct. 30, 2018

(54) SUPPORT APPARATUS FOR USE WITH MIXING VESSEL

(71) Applicant: Don Beardsley, Auburn, NY (US)

(72) Inventor: Don Beardsley, Auburn, NY (US)

( * ) Notice: Subject to any disclaimer, the term of this patent is extended or adjusted under 35 U.S.C. 154(b) by 45 days.

(21) Appl. No.: 15/102,135

(22) PCT Filed: Dec. 5, 2014

(86) PCT No.: PCT/US2014/068807

§ 371 (c)(1),
(2) Date: Jun. 6, 2016

(87) PCT Pub. No.: WO2015/085180

PCT Pub. Date: Jun. 11, 2015

(65) Prior Publication Data

US 2016/0310919 A1 Oct. 27, 2016

Related U.S. Application Data

(60) Provisional application No. 61/912,913, filed on Dec. 6, 2013.

(51) Int. Cl.
*B01F 15/00* (2006.01)

(52) U.S. Cl.
CPC ..... *B01F 15/00772* (2013.01); *B01F 2215/0047* (2013.01)

(58) Field of Classification Search
USPC ..... 366/341
See application file for complete search history.

(56) References Cited

U.S. PATENT DOCUMENTS

| | | | | |
|---|---|---|---|---|
| 2,112,155 | A | 1/1936 | Haney et al. | |
| 2,959,387 | A | 11/1959 | Ficek | |
| 4,084,701 | A | 4/1978 | White | |
| 4,398,690 | A | 8/1983 | Rutledge | |
| 6,361,001 | B1 | 3/2002 | Durand | |
| 6,829,800 | B2 | 12/2004 | Roebuck | |
| 7,178,766 | B2 | 2/2007 | Forshee et al. | |
| 7,261,262 | B2 | 8/2007 | Dunson | |
| 8,876,069 | B2 * | 11/2014 | Cimaglio | B01F 15/00746 248/122.1 |
| 9,669,369 | B1 * | 6/2017 | Mees | B01F 15/00772 |
| 2003/0016586 | A1 | 1/2003 | Williams | |
| 2003/0223306 | A1 | 12/2003 | Foster, Jr. | |
| 2005/0045780 | A1 * | 3/2005 | Forshee | B01F 15/00733 248/146 |
| 2007/0076519 | A1 | 4/2007 | Kesling | |
| 2007/0252051 | A1 | 11/2007 | Kuipers | |
| 2011/0198457 | A1 | 8/2011 | Rauchut | |

OTHER PUBLICATIONS

PCT/2014/068807; International Filing Date Dec. 5, 2014; International Search Report and Written Opinion; dated Mar. 16, 2015; 8 pages.

* cited by examiner

*Primary Examiner* — Mark Halpern
(74) *Attorney, Agent, or Firm* — Barclay Damon LLP

(57) ABSTRACT

This disclosure describes embodiments of a support system that stabilizes the mixing vessel to allow a single individual to complete the mixing process. The support system can utilize one or more support apparatuses, which can engage the mixing vessel. These support apparatuses are also configured to allow the individual to secure the support apparatuses to a surface, such as the ground or a platform, during operation of the mixing device.

16 Claims, 7 Drawing Sheets

SUPPORT APPARATUS FOR USE WITH MIXING VESSEL

CROSS-REFERENCE TO RELATED APPLICATIONS

This application is a 371 of PCT/US14/68807 filed 5 Dec. 2014, which claims priority to, and the benefit of, U.S. Patent Application No. 61/912,913, filed on Dec. 6, 2013. The entire contents of such applications are hereby incorporated by reference.

BACKGROUND OF THE INVENTION

The subject matter disclosed herein relates to mixing and mixing technology of, for example, construction materials, with particular discussion about a support system that is useful to stabilize a mixing vessel for use in small batch mixing processes.

Many construction materials, such as concrete, mortar, epoxy, etc., are mixed and/or prepared in small batches at a worksite. These materials may, for example, consist of one or more constituent components in the form of dry powders, pastes, and liquids. Preparation may include steps to combine the constituent components in a mixing vessel, such as a bucket. The steps also typically add a solvent, such as water. To complete the process, a mixing device, such as a drill or auger, turns a mixing implement, such as an auger blade, to churn the constituent components together until the composition achieves the consistency or other characteristics desired.

For many materials, the constituent components form a composition with a relatively high viscosity. Because of this high viscosity, the mixing device generates a great deal of torque to move the mixing implement through the composition to thoroughly mix the constituent components together. Typically, the mixing device operates at very high speeds to achieve this torque. These high speeds, alone or in combination with the high viscosity of the ingredients, can cause the mixing vessel to become unstable, often having a tendency to move, shake, and/or spin during operation of the mixing device.

Few remedies are available to stabilize the mixing vessel during the mixing process. In practical applications, an operator of the mixing device might position the mixing vessel between the legs or construct some other type of rudimentary system out of remnant materials such as those found at the work site. The mixing device operates at such high speeds, however, that these conventional techniques are typically ineffective. Employing a second individual to stabilize the mixing vessel, while potentially helpful, raises concerns as to the safety of the individual in proximity to the mixing device and, notably, the blades of the mixing implement. On the other hand, use of particularly designed hardware, such as a mixing stand, can be cost-prohibitive.

BRIEF SUMMARY OF THE INVENTION

This disclosure describes embodiments of a support system that stabilizes the mixing vessel to allow a single individual to complete the mixing process. The support system can utilize one or more support apparatuses, which can engage the mixing vessel. These support apparatuses are also configured to allow the individual to secure the support apparatuses to a surface, such as the ground or a platform during operation of the mixing device.

In one embodiment, a support apparatus for use with a mixing vessel includes an upright portion having a first end and a second end opposite the first end. The mixing vessel includes a bottom configured to rest on a surface and a side wall including a top edge, the bottom and side wall coupled to form an interior volume containing a material to be mixed. The support apparatus also includes an engagement element at the first end configured to extend over the top edge of the side wall into the interior volume. The support apparatus further includes a foot element at the second end disposed substantially perpendicular to the upright portion and configured to receive a load to stabilize the mixing vessel on the surface.

In another embodiment, a mixing vessel includes a bottom configured to rest on a surface and a side wall including a top edge, the bottom and the side wall coupled to form an interior volume containing a material to be mixed. A method for stabilizing the mixing vessel includes fastening an engagement element of a support apparatus on a top edge of the wall of the mixing vessel. The method also includes placing a load on a foot element of the support apparatus. The method further includes mixing the material contained in the mixing vessel.

BRIEF DESCRIPTION OF THE DRAWINGS

Reference is now made briefly to the accompanying drawings, in which.

Where applicable like reference characters designate identical or corresponding components and units throughout the several views, which are not to scale unless otherwise indicated.

DETAILED DESCRIPTION OF THE INVENTION

Figure 1:
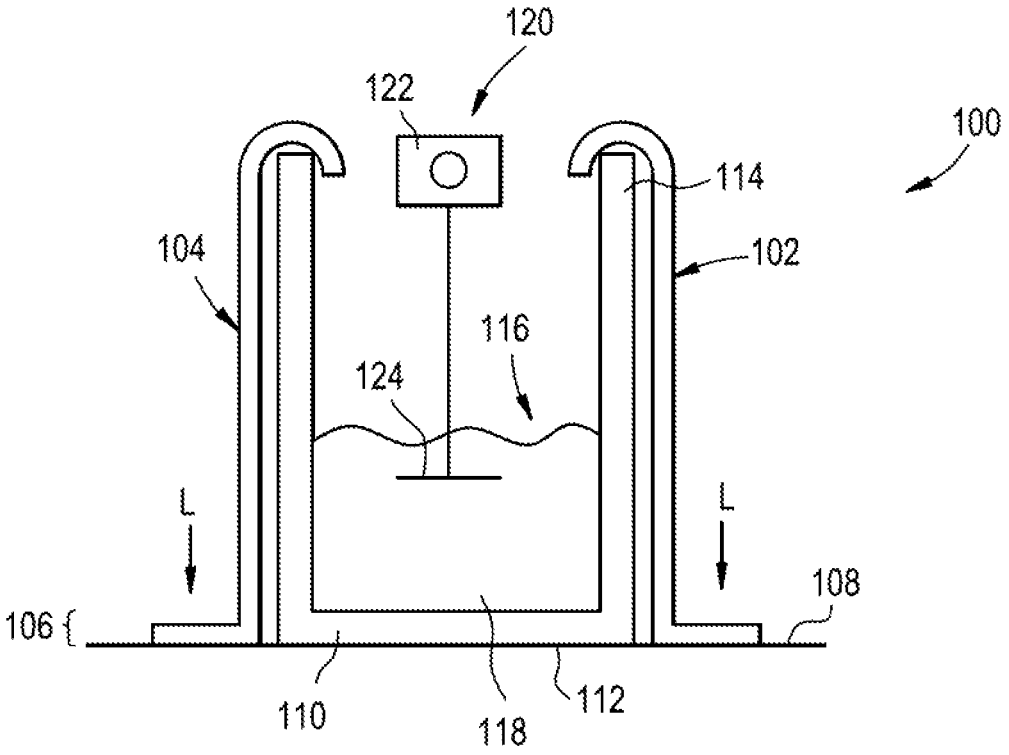
FIG. 1 depicts a side cross-section view of an exemplary embodiment of a support system that can stabilize a mixing vessel in use during small batch mixing processes.

FIG. 1 illustrates an elevation, cross-section view of an exemplary embodiment of a support system 100 for use to mix small batches of material such as concrete, grout, adhesive, mortar, etc. The system 100 includes one or more support apparatuses, illustrated here as a first support apparatus 102 and a second support apparatus 104, each having a portion 106 in contact with a surface 108. The surface can be any suitable surface such as a floor, a platform, a table, and/or other area at and/or proximate a worksite. The portion 106 can receive a load L. This load can be applied in any suitable manner. For example, the load L can be applied by a user standing on the portion 106. However, this disclosure does contemplate other configurations of the system 100 in which the portion 106 merely distributes (or directs) loading to the surface 108. For example, the load L may be applied onto one or more of the support apparatuses 102, 104 in areas other than the portion 106.

As shown in FIG. 1, the support apparatuses 102, 104 are disposed proximate a mixing vessel 110 that can also reside on the surface 108. The mixing vessel 110 has a bottom 112 and a peripheral side wall 114 that, in one example, couples with the bottom 112 to form an interior volume 116 of the mixing vessel 110. The interior volume 116 contains, in one example, a material 118 that is subject to a mixing process. Examples of the mixing process may employ a mixing device 120, such as a drill, an auger, etc., having a powered end 122 and a mixing end 124 that extends into the material. Activation of the powered end 122 rotates the mixing end 124, churning and mixing the material 118 in the mixing vessel 110. In practical applications, the mixing vessel 110 comprises a bucket or like implement, typically of a size and configuration that allows an individual to assume, for example, a standing position, a sitting position, and/or a kneeling position, while operating the mixing device 120.

Broadly, use of the system 100 helps to stabilize the mixing vessel 110 during operation of the mixing device 114. In one implementation, an end user positions the support apparatuses 102, 104 on opposite sides of the mixing vessel 110. Configurations of the support apparatuses 102, 104 can also engage, couple with, and/or otherwise come into contact with a part of the mixing vessel 110. As shown in FIG. 1, this part may include a top edge(s) and/or an outer peripheral surface(s) of the peripheral side wall 114 on the mixing vessel 110. With the support apparatuses 102, 104 in position, the end user can position a part of the body, such as a foot, knee, etc., on the portion 106 of the support apparatuses 102, 104 to apply the load L. In another example, the end user can position a weight, such as a concrete block, on the portion 106 of the support apparatuses 102, 104 to apply the load L. This loading effectively anchors the support apparatuses 102, 104 to the surface 108, which in turn, can prevent (and/or minimize) movement of the mixing vessel 110 relative to the surface 108 during operation of the mixing device 120. While the support system 100 is illustrated here as including two support apparatuses 102, 104, it is to be understood that the support system 100 can include one or more support apparatuses, depending on the design of the support system 100.

Figure 2:
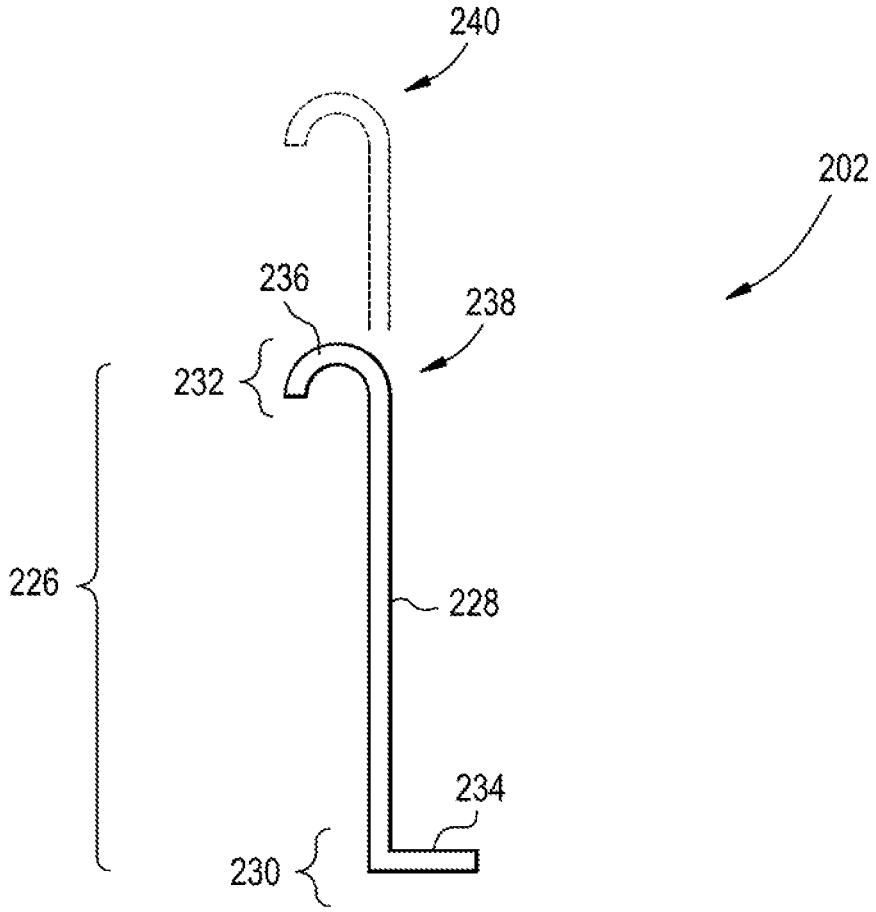
FIG. 2 depicts a side view of an exemplary embodiment of a support apparatus.

With continued reference to FIG. 1, the illustration of FIG. 2 depicts a side, elevation view of an exemplary embodiment of a support apparatus 202 that can reduce movement of a vessel, such as mixing vessel 110, during small batch mixing processes. The support apparatus 202, has a generally elongated body 226 with an upright portion 228, a first end 230 (i.e., "a base end" 230), and a second end 232 (i.e., "a top end" 232). At the first end 230, the elongated body 226 has a foot 234 that, in one example, extends generally perpendicular to the upright portion 228. The second end 232 includes an engagement element 236 with a bent and/or angularly disposed configuration, for example, in the form of a hook configuration. As also shown in FIG. 2, the engagement element 236 can move relative to the foot 234 to position the engagement element 236 among a number of positions, for example a first position 238 and a second position 240.

The support apparatus 202, can utilize configurations for the upright portion 228 that extend and retract to change the position of the engagement element 236. These configurations can locate the engagement element 236 in position proximate the top edge(s) of the mixing vessel 110. This variety of configurations can accommodate different constructions of the mixing vessel 110, such as different sizes relative to the surface 108.

Examples of the engagement element 236 are useful to prevent movement of the mixing vessel 110 relative to the surface 108. These examples can utilize various configurations, including the hook configuration shown in FIG. 2, that act as an aid to stabilize the mixing vessel 110. These configurations can engage or couple with the mixing vessel 110 proximate the top edge; however, this engagement may not be necessary in lieu of having a part of the engagement element 236 that extends over the top edge toward the middle (i.e., central axis) of the mixing vessel 110. This part can restrict "vertical" movement, as well as rocking, of the mixing vessel 110 during operation of the mixing device 120. As shown by the hook configuration, the engagement element 236 can have a part that extends into the interior volume 116 of the mixing vessel 110. In one embodiment, the mixing vessel 110 may be particularly designed to interface with the engagement element 236. This design may incorporate one or more features, for example a notch, a detent, etc., that is particularly useful to align, engage, and/or make contact with the support element and/or one or more other components of the support system 200 as noted herein.

Figure 3:
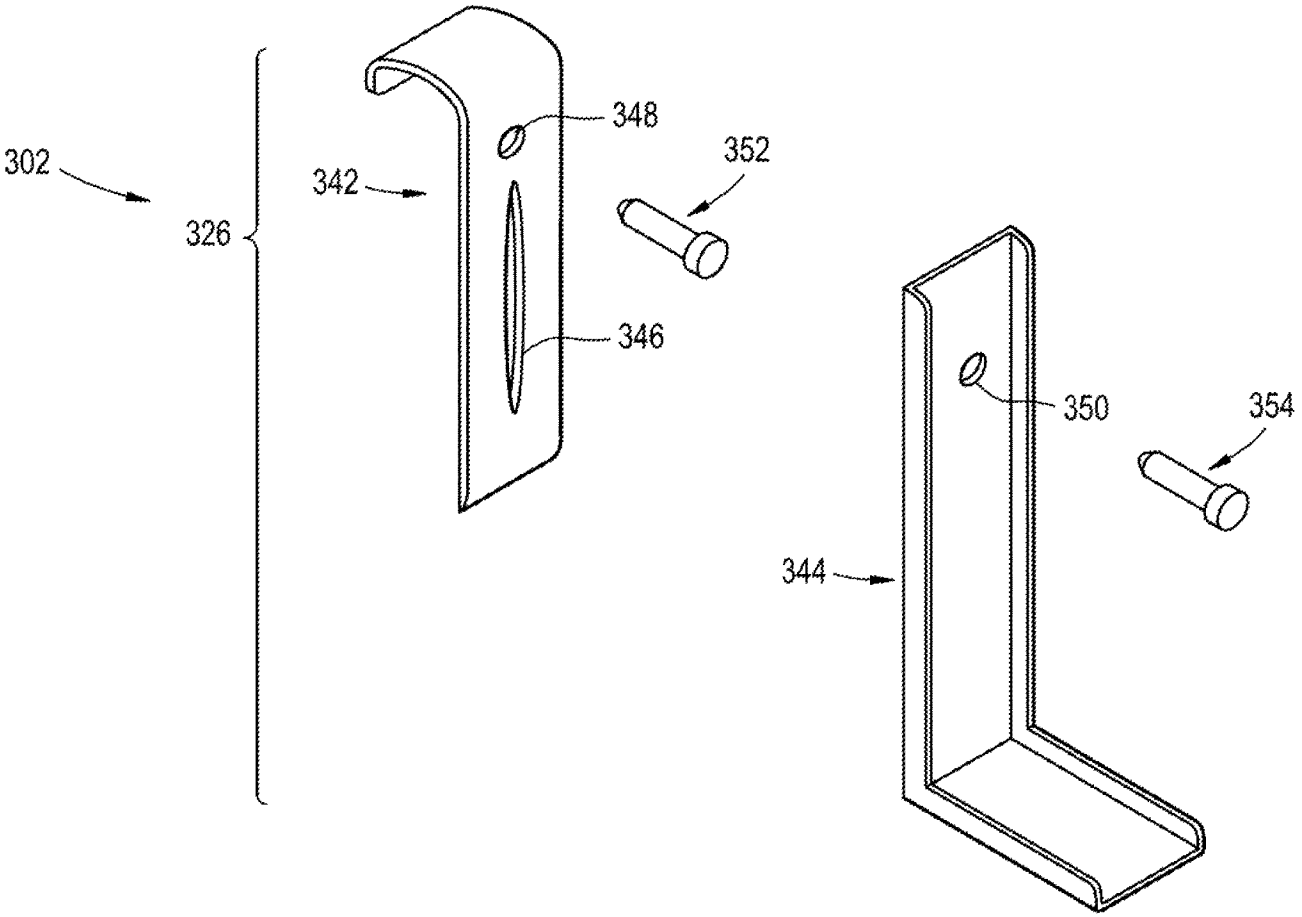
FIG. 3 depicts a perspective view of an exemplary embodiment of a support apparatus in exploded form.

FIG. 3 illustrates a perspective view of another exemplary embodiment of a system 300 to show one construction for the support apparatuses 302, shown in this example in exploded form. This construction is useful to accommodate mixing vessels of varying sizes. In FIG. 3, the elongated body 326 includes a plurality of body elements, illustrated here as a first body element 342 and a second body element 344. The first body element 342 can include a slot feature 346 and a first coupling feature 348. The second body element 344 can include a second coupling feature 350. The first coupling feature 348 and second coupling feature 350 can be, for example, a hole, a slot, or any other suitable design for receiving a fastening element. In one embodiment, the system 300 can include one or more fastening elements, illustrated as a first fastening element 352 and a second fastening element 354. For example, the fastening elements 354, 354 can be knobs, bolts, or any other suitable type of fastener.

Figure 4:
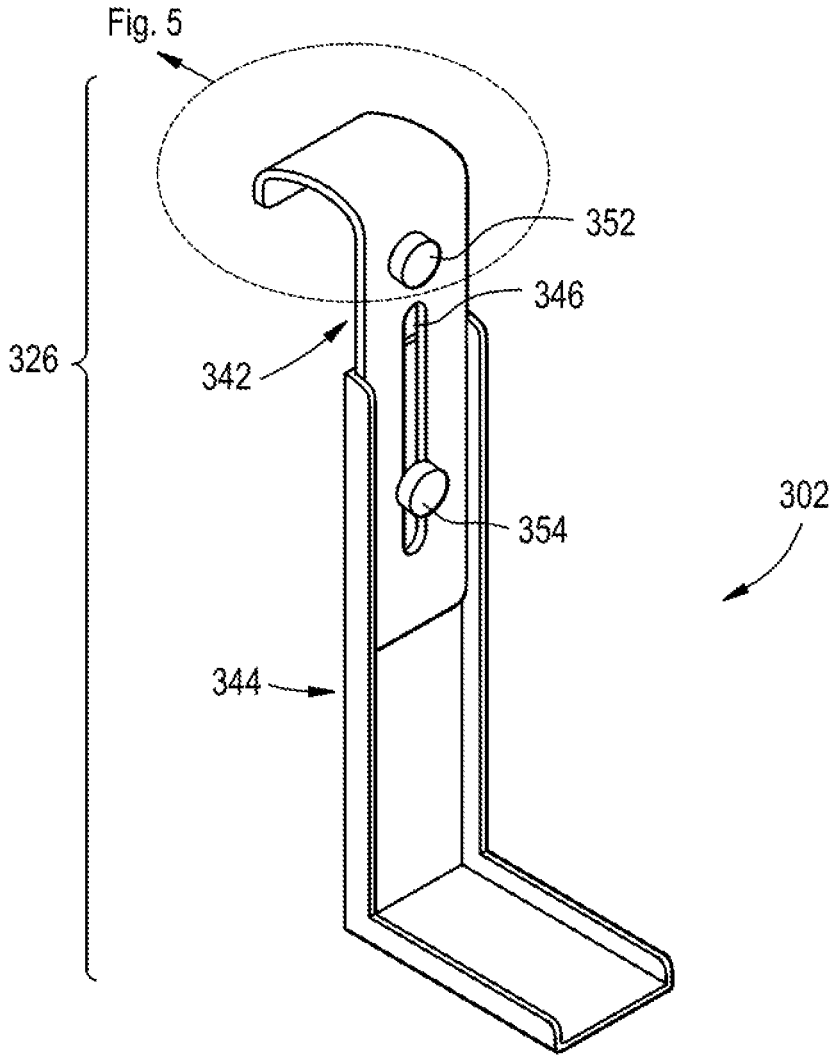
FIG. 4 depicts the support apparatus of FIG. 3 in assembled form.
Figure 5:
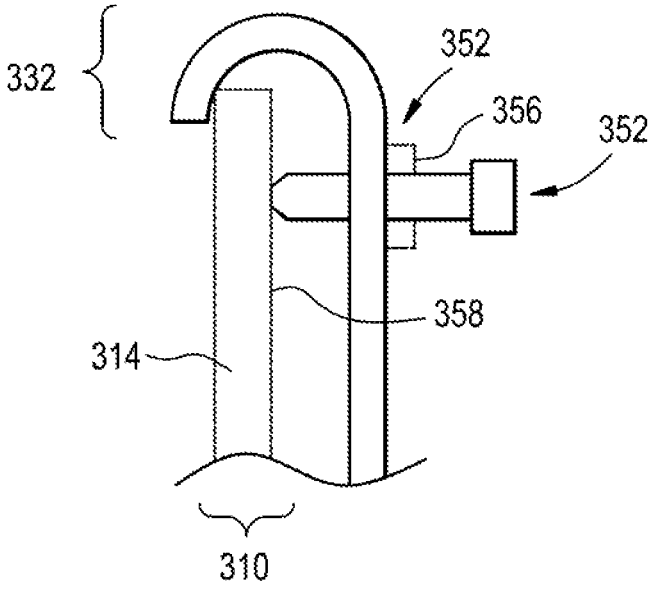
FIG. 5 depicts a detail view of an end of the support apparatus of FIGS. 3 and 4 to illustrate one configuration that is useful to engage a mixing vessel.

The illustrations of FIGS. 4 and 5 depict the system 300 with the elongated body 326 in assembled form. In one example, the first body element 342 slides and/or inserts into the second body element 344. The second fastening element 354 penetrates through the slot feature 346 to engage the second coupling feature 350 on the second body element 344. The first fastening element 352 installs on the first coupling feature 348. As best shown in the detail view of FIG. 5, in one example, the first fastening element 352 can penetrate through the first coupling feature 348, shown here as a boss coupling 356. The first fastening element 352 can engage and/or contact the outer surface 358 of the peripheral side wall 314 of the mixing vessel 310. In one implementation, the first fastening element 352 causes the mixing vessel 310 to contact a part of the engagement element 332, thereby holding the mixing vessel 310 in place between the fastening element 352 and the engagement element 332.

Figure 6A:
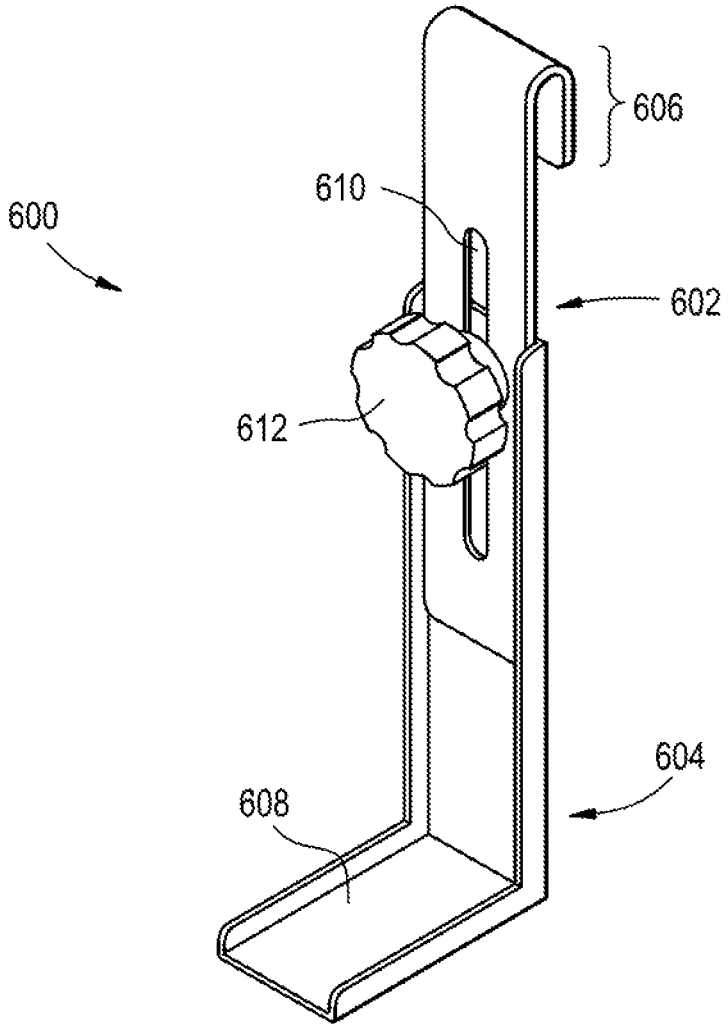
FIGS. 6A-6C depict views of another exemplary embodiment of a support apparatus.
Figure 6B:
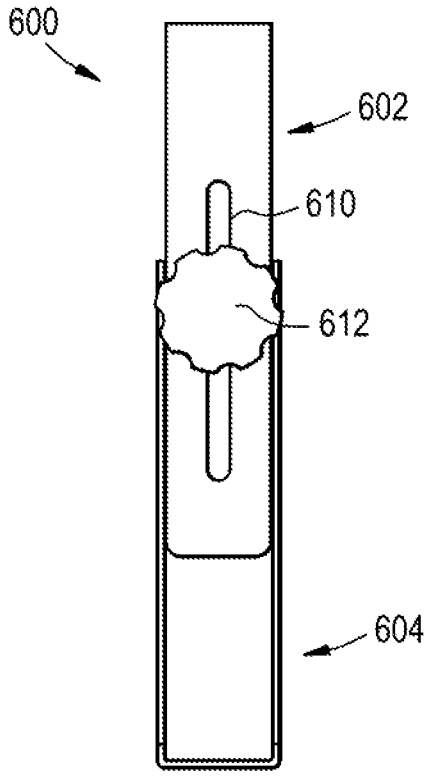
Figure 6C:
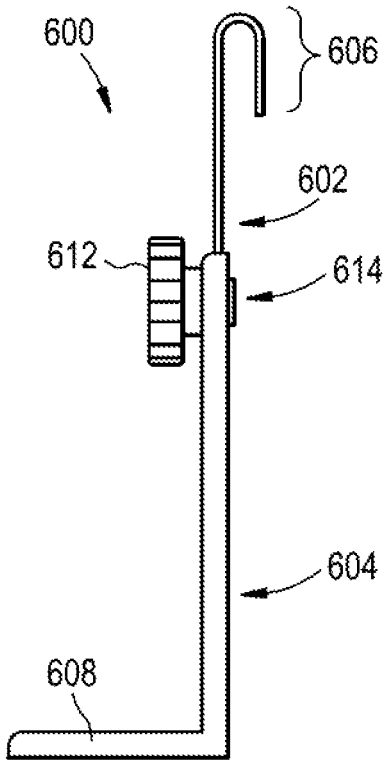

FIGS. 6A-6C depict views of another exemplary embodiment of a support apparatus 600. The support apparatus 600 includes a first body element 602 and a second body element 604. The first body element 602 includes an engagement element 606. The engagement element 606 is designed to engage a mixing vessel, such as mixing vessel 110. For example, and as illustrated here, the engagement element 606 can have a hook shape, configured for extending over a top edge of a side wall of the mixing vessel. The second body element 604 includes a foot portion 608. The foot portion 608 extends substantially parallel to a surface, such as the ground, on which the support apparatus 600, and the mixing vessel, is placed and extends in a direction opposite the direction in which the engagement element 606 faces. The foot portion 608 is configured to receive a load and/or transfer the load to the surface to stabilize the mixing vessel.

The first body element 602 includes a coupling element, illustrated here as a slot 610, through which a fastening element 612 extends. The fastening element 612 also extends through a coupling element 614, such as a hole, of the second body element 604, coupling the first body element 602 to the second body element 604. By employing the slot 610, the first body element 602 can be placed in a variety of positions relative to the second body element 604. This variety of positions allows the support apparatus 600 to be used with a variety of mixing vessels. For example, moving the first body element 602 from a first position to a second position can change the length of the support element 600, extending or retracting the support element 600.

At a relatively high level, construction of the embodiments and examples disclosed herein can employ any variety of materials and techniques. Materials can include metals, such as aluminum, steel, stainless steel, etc., plastics and polymers, composites, and compositions and combinations thereof. These materials may be amenable to machining, such as, turning, milling, etc., and bending that can form one or more features, for example, on the support apparatuses 102, 104, 202, 302. In some implementations, the construction may utilize one or more coatings layers, such as paint, powder coating, etc., disposed on one or more surfaces of the corresponding part and/or component.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A support apparatus for use with a mixing vessel, the mixing vessel comprising a bottom configured to rest on a surface and a side wall comprising a top edge, the bottom and the side wall coupled to form an interior volume containing a material to be mixed, the support apparatus comprising:

an upright portion having a first end and a second end opposite the first end;

an engagement element at the first end of the upright portion configured to extend over the top edge of the side wall into the interior volume;

a fastening element configured to contact and secure the mixing vessel between the engagement element and the fastening element; and a foot element at the second end disposed substantially perpendicular to the upright portion and configured to receive a load to stabilize the mixing vessel on the surface.

2. The support apparatus of claim 1, wherein a length of the upright portion is adjustable.

3. The support apparatus of claim 2, wherein the foot element is configured to extend in a direction opposite the engagement element.

4. The support apparatus of claim 3, wherein the foot element is substantially parallel to, and is configured to rest on, a surface on which the mixing vessel rests.

5. The support apparatus of claim 1, wherein the load comprises a user foot located on the foot element.

6. The support apparatus of claim 5, wherein the engagement element comprises a hook shape.

7. The support apparatus of claim 1, wherein the support apparatus further comprises:

a first body element comprising the engagement element; and a second body element comprising the foot element, wherein the first body element and the second body element are configured to be coupled.

8. The support apparatus of claim 7, further comprising a fastening element configured to couple the first body element and the second body element.

9. The support apparatus of claim 8, wherein the first body element and the second body element each comprise a coupling feature configured to receive the fastening element to couple the first body element and the second body element.

10. The support apparatus of claim 9, wherein the coupling feature of the first body element comprises a slot, the slot configured to allow the first body element to extend and retract relative to the second body element.

11. The support apparatus of claim 1, wherein the top edge of the sidewall of the mixing vessel defines an opening into the interior volume, and wherein the engagement element is configured to extend over the top edge of the sidewall while leaving the opening into the interior volume of the mixing vessel unobscured.

12. A method for stabilizing a mixing vessel with a support apparatus comprising an upright portion having a first end on which the engagement element is disposed and a second end and a second end opposite the first end, on which the foot element is disposed, the mixing vessel comprising a bottom configured to rest on a surface and a side wall comprising a top edge, the bottom and the side wall coupled to form an interior volume containing a material to be mixed, the method comprising:

fastening an engagement element of a support apparatus on a top edge of the side wall of the mixing vessel so that the engagement element extends over the top edge of the side wall into the interior volume of the mixing vessel;

placing the foot element of the support apparatus on the surface;

placing a load on the foot element of the support apparatus; and mixing the material contained in the mixing vessel.

13. The method of claim 12, wherein the step of placing the load comprises placing a user's foot on the foot element.

14. The method of claim 12, further comprising adjusting a length of the support apparatus based on a height of the side wall such that the engagement element extends over the side wall and the foot element rests on the surface.

15. The method of claim 12, further comprising:

fastening an engagement element of a second support apparatus on the top edge of the wall of the mixing vessel opposite the support apparatus; and placing a load on a foot element of the second support apparatus, the load comprising a user's second foot.

16. The method of claim 12, wherein the top edge of the sidewall of the mixing vessel defines an opening into the interior volume, and wherein the engagement element is configured to extend over the top edge of the sidewall while leaving the opening into the interior volume of the mixing vessel unobscured.

* * * * *